US005408056A

United States Patent [19]

Thomas

[11] Patent Number: 5,408,056

[45] Date of Patent: Apr. 18, 1995

[54] COMPONENT SUPPORTING

[75] Inventor: David E. Thomas, Northbridge, Mass.

[73] Assignee: Bose Corporation, Framingham, Mass.

[21] Appl. No.: 651,194

[22] Filed: Feb. 6, 1991

[51] Int. Cl.[6] ..... H04R 7/16; D03D 15/00

[52] U.S. Cl. ..... 181/171; 428/225

[58] Field of Search ..... 181/171, 172, 199, 169; 381/205, 169; 428/225, 288, 257, 258, 259

[56] References Cited

U.S. PATENT DOCUMENTS 4,239,944 12/1980 Obara et al. ..... 381/205
4,568,581 2/1986 Peoples, Jr. ..... 428/36.1
4,946,738 8/1990 Chenoweth et al. ..... 428/288

*Primary Examiner*—W. B. Perkey
*Attorney, Agent, or Firm*—Fish & Richardson

[57] ABSTRACT

A transducer component support has a fabric with at least two thermoplastic polymer fibers with different melt temperatures.

17 Claims, 1 Drawing Sheet

COMPONENT SUPPORTING

The invention relates in general to transducer component supporting and more particularly to supporting a component of a loudspeaker driver.

A typical loudspeaker driver has an annular element, or spider, that resiliently supports the voice coil assembly. Traditionally, the spider is made from a cotton fabric that is impregnated with a phenolic resin solution. The phenolic impregnated fabric is pressure and heat treated in a die mold to form the final spider shape, and the cured phenolic resin, serves as an adhesive and a stiffener, to maintain the shape of the spider.

In general, the invention features, in one aspect, a transducer component support, such as a spider for a loudspeaker driver, that is made from a fabric including a thermoplastic polymer fiber and a stiffening adhesive. In preferred embodiments, the thermoplastic polymer fiber is a liquid crystal polymer and the adhesive is introduced into the fabric as a second fiber having a lower melt temperature than the first fiber. Preferably, the second fiber is also a liquid crystal polymer fiber. However, other fibers having the appropriate melt temperature characteristics, such as polyester, may also be used.

In another aspect, the invention features a spider having a more traditional principal fabric fiber (such as cotton) and a stiffening adhesive that is introduced into the weaving yarn as a second fiber having thermoplastic characteristics (i.e. melts at a known temperature). This blended yarn is then woven into the desired fabric construction. Preferably, the second fiber is a liquid crystal polymer fiber.

It is preferable that the spider fabric be woven. However, any method for forming the fabric, such as knitting or forming in a felt process, may be used.

A transducer component support, such as a spider, made from a liquid crystal polymer (LCP) fiber has exceptional stress relaxation resistance, fatigue resistance, and environmental resistance. In addition, for an equivalent radial stiffness, an LCP spider has relatively low axial stiffness, resulting in improved linearity and increased compliance in the axial direction.

A spider in which the stiffening adhesive is introduced into the fabric of the spider as a fiber with a lower melt temperature than that of the principal fiber of the fabric has relatively low mass and more relatively consistent mechanical behavior. Its properties can be controlled relatively precisely. This is due to improved control of the character and amount of fabric binder (i.e. low melt fiber).

Other features and advantages of the invention will be apparent from the following description and from the claims when read in connection with the accompanying drawings in which:

A transducer component support, such as a spider made from blended liquid crystal polymer (LCP) yarns, has exceptional stress relaxation resistance and environmental resistance by taking advantage of the special properties of the thermoplastic polymer fibers. A liquid crystal polymer is capable of forming a liquid crystalline phase in which parts of the polymer molecules are ordered with a degree of order between the very regular three-dimensional orientational and positional order of a crystalline phase and the high disorder of a liquid. Liquid crystalline materials are characterized by long-range orientational order and by a lack of positional order in at least one dimension.

The weight of a spider may be reduced and the stiffness controlled with enhanced precision if the binder for stiffening the fabric is furnished by melting a low-melting-point fiber yarn which is blended into the yarn prior to weaving.

The spider described herein is preferably made from Vectran, a thermoplastic polymer yarn made from a liquid crystal polymer (LCP) fiber (Hoechst Celanese, Fibers and Film Group, Charlotte, N.C.). The fabric of the spider is preferably woven from two different Vectran fibers: Vectran HS, 200 denier (melt point=625° F.) and Vectran M, 200 denier (melt point=525° F.).

Figure 1:
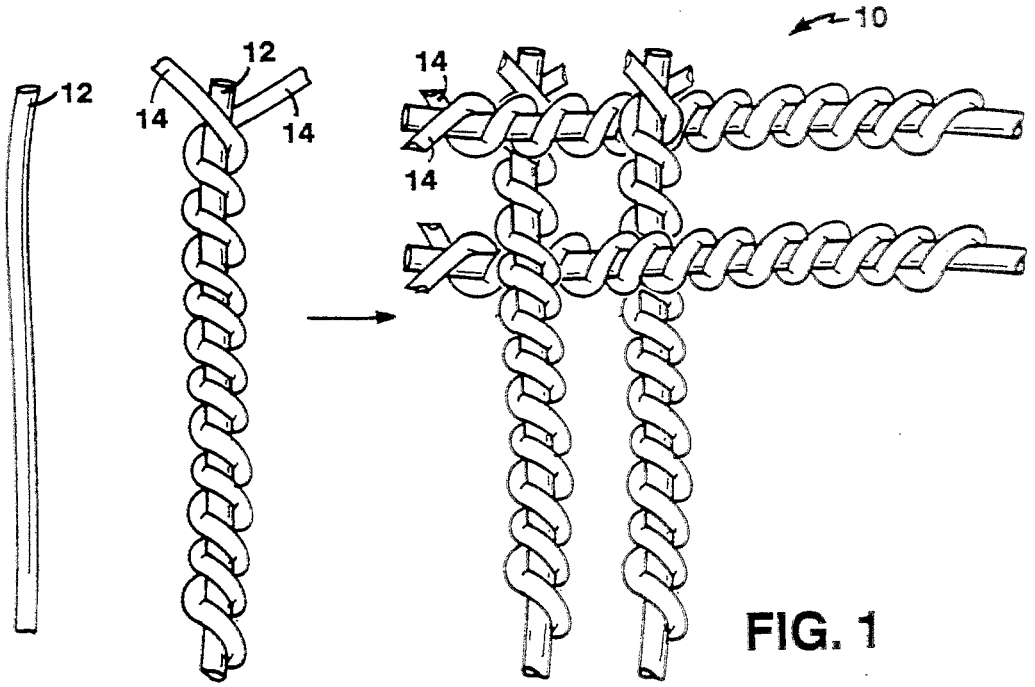
FIG. 1 is a schematic view of a section of fabric for an LCP spider.

Referring to FIG. 1, a bolt of plain weave fabric 10 is formed with Vectran HS fibers 12 and Vectran M fibers twisted or commingled together to form a blended yarn. This yarn is then woven into a plain weave with 30–40 yarns per inch in both warp and fill direction. The blending process is performed such that 15–50% by weight of Vectran M is incorporated into the final fabric. The Vectran M, having a lower melting point, bonds the strands of the fabric together during processing, as described below.

Figure 2:
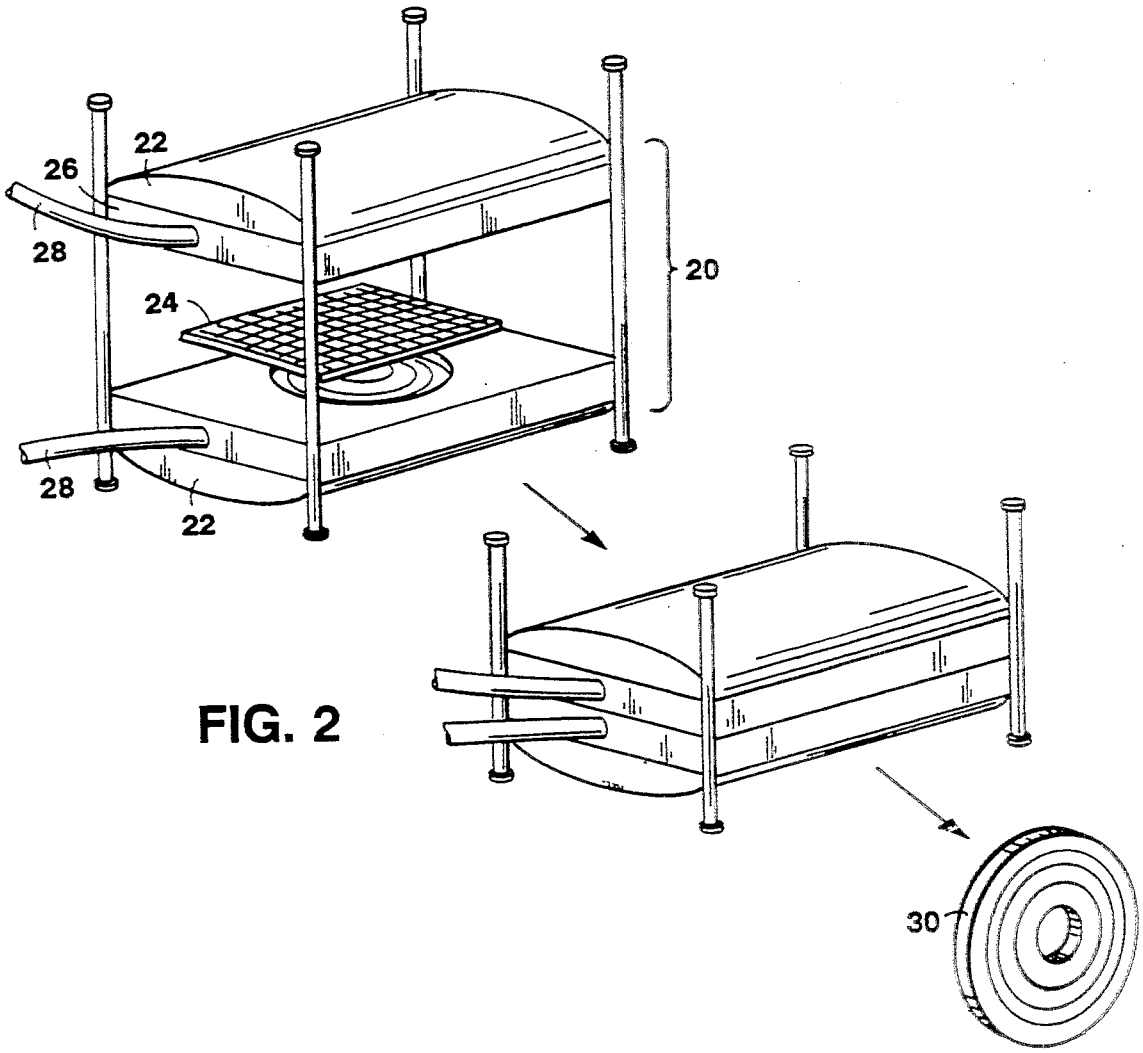
FIG. 2 is a view of a die set-up for fabricating an LCP spider.

Referring to FIG. 2, a two piece matched die setup 20 in a heated platen pneumatic press 22 forms the fabric into the shape of a finished spider. As a first step, the dies are heated to 560° F., above the melting temperature of the Vectran M (melt point −525° F.). Next, a 4″×4″ piece of fabric 24 is placed between the die halves, and the temperature is brought back up to 560° F. After the temperature has stabilized, a pressure of one psi is applied through the top die 26. After one minute of heating, the die heaters 28 are turned off; the dies are allowed to cool, naturally or with forced convection to approximately 350° F.; and the die halves are pulled apart. The LCP fabric spider 30 is then removed and allowed to cool to room temperature. As heating the composite fabric above the melting temperature of the Vectran M causes the melted Vectran M fibers to flow and impregnate the Vectran HS fibers, the Vectran M serves as a binder to hold the HS fibers together, and the cooled spider retains its characteristic shape.

An LCP spider prepared as above according to the invention has several important advantages. It has good fiber locking as a result of the melt impregnation of the M yarn around the HS yarn. It has relatively high radial stiffness. It has satisfactory compliance with improved stress relaxation resistance as evidenced by a spider whose compliance remained substantially unchanged through a half a million cycles of use in a loudspeaker driver. In similar life tests, the compliance of a cotton phenolic spider changes, ultimately, and stabilizes at approximately one half of its original compliance. Additionally, the LCP spider of the invention, free of phenolic resin mass, is 40% lower in mass compared to the same configuration cotton phenolic spider, thereby reducing the effective moving mass of the loudspeaker driver. The loudspeaker driver, the LCP spider according to the invention is also relatively insensitive to temperature and humidity effects.

Other embodiments are within the following claims. For example, a spider with similar characteristics may be prepared using any kind of synthetic fiber, such as a polyester fiber, that has a lower melting temperature than the principal LCP fiber, to provide the fiber binder function. A spider with all the advantages of reduced mass may be made with any fabric fiber (e.g., cotton) as the principal structural fiber and a thermoplastic fiber to provide the fabric binder, instead of an impregnating adhesive such as a phenolic resin.

The process for preparing a spider according to the invention may be varied depending upon the desired characteristics of the finished spider. The specific temperature to which the dies are heated is initially chosen based on the melt temperatures of the two fibers incorporated in the fabric. With these melt temperatures as starting points, the specific flow of the binder fiber, i.e., how much it will impregnate the fiber, may be controlled by using a higher or lower heat temperature for the die relative to the melting point of the low melt point fiber. A higher temperature produces a stiffer spider. A lower temperature produces a more compliant spider. Generally a temperature range from 525° F. to 600° F. is preferred for the LCP blended yarn system.

The pressure applied to the die may vary from 1 to 100 psi. The pressure in the forming process has less of a direct influence on the stiffness of the resulting spider than does the temperature, but the stiffness of the spider may be adjusted by increasing or reducing the pressure as by changing the temperature. However, it is preferable to control the stiffness of the spider with temperature.

The set time is not critical and may be as long as 10–15 minutes or as short as 10 seconds. However, it is desirable to keep the set time to under 15 minutes to prevent the fibers from degrading.

The temperature at which the spider is removed from the dies 26 may depend on other processing considerations. As the spider holds its shape better at a lower temperature, it is preferable to remove the spider at a temperature below the heat deflection temperature of the fibers. For manufacturing speed, it is desirable to remove the spider from the dies as soon as possible.

With the use of a spider fabric containing an "binder" fiber, it is possible to control the response characteristics of a transducer spider entirely through the manufacturing process rather than depending on the more empirical process of varying the percentage of a liquid resin (e.g. phenolic) in the fabric. While a woven spider is preferred, the fabric may be formed by any method, such as knitting or a felting. The ratio of the binder fiber to the forming fiber may be from 15% to 50% and is varied as necessary for a given products requirement.

What is claimed is:

1. A transducer component support comprising a woven fabric comprising at least two fibers with different melt temperatures.

2. The transducer component support of claim 1 wherein one of the said fibers is a liquid crystal polymer.

3. The transducer component support of claim 1 wherein one of the said fibers resides in said fabric as a second fiber having a lower melt temperature than that of said first fiber.

4. The transducer component support of claim 3 wherein said second fiber comprises a polyester.

5. The transducer component support of claim 3 wherein said second fiber comprises a liquid crystal polymer fiber.

6. The transducer component support of claim 1 wherein one of said fibers comprises a phenolic resin.

7. The transducer component support of claim 1 wherein said woven fabric comprises a set of first fibers having a first melt temperature, and a set of second fibers having a second melt temperature, said second fibers impregnating said first fibers and serving as a binder to hold said first fibers together.

8. The transducer component support of claim 1 wherein said different melt temperatures differ from each other by substantially 100° F.

9. The transducer component support of claim 8 wherein said different melt temperatures are of the order of 625° F. and 525° F.

10. A transducer component support comprising a woven fabric comprising a first fiber and a stiffening binder that is a second fiber having a lower melt temperature than that of said first fiber.

11. The transducer component support of claim 10 wherein said second fiber comprises a polyester.

12. The transducer component support of claim 10 wherein said second fiber comprises a liquid crystal polymer fiber.

13. The transducer component support of claim 10 wherein said first fiber comprises nonthermoplastic fiber.

14. The transducer component support of claim 13 wherein said first fiber comprises cotton.

15. The transducer component support of claim 10 wherein said woven fabric comprises a set of first fibers having a first melt temperature, and a set of second fibers having a second melt temperature, said second fibers impregnating said first fibers and serving as a binder to hold said first fibers together.

16. The transducer component support of claim 10 wherein said different melt temperatures differ from each other by substantially 100° F.

17. The transducer component support of claim 16 wherein said different melt temperatures are of the order of 625° F. and 525° F.

* * * * *